US005660423A

United States Patent [19]

Herman et al.

[11] Patent Number: 5,660,423

[45] Date of Patent: Aug. 26, 1997

[54] ABRASION GUARD FOR LIFTING SLING FITTINGS

[75] Inventors: Mark A. Herman, Landisville; Jeffrey M. Klibert, Lancaster, both of Pa.

[73] Assignee: Lift-All Company, Inc., Manheim, Pa.

[21] Appl. No.: 611,997

[22] Filed: Mar. 5, 1996

[51] Int. Cl.[6] ..... B66C 1/12

[52] U.S. Cl. ..... 294/74; 294/82.11; 24/197

[58] Field of Search ..... 294/82.1, 82.11, 294/74–76; 24/197; 59/90, 93

[56] References Cited

U.S. PATENT DOCUMENTS

| | | | |
|---|---|---|---|
| 2,356,146 | 8/1944 | Caldwell | 294/74 |
| 2,436,247 | 2/1948 | Bufflap | 294/74 |
| 2,835,528 | 5/1958 | McCarthy et al. | 294/74 |
| 3,153,828 | 10/1964 | Glover | 294/74 |
| 3,352,590 | 11/1967 | Barthule | 294/74 |
| 3,583,750 | 6/1971 | Norton | 294/74 |
| 3,778,095 | 12/1973 | Carr | 294/74 |
| 4,429,526 | 2/1984 | Rehbein | 294/82.11 |
| 4,842,914 | 6/1989 | Franke | 294/74 |
| 5,123,690 | 6/1992 | Bailey | 294/74 |

FOREIGN PATENT DOCUMENTS

| | | | |
|---|---|---|---|
| 2415-598 | 9/1979 | France | 294/74 |
| 2806-996 | 8/1979 | Germany | 294/74 |

*Primary Examiner*—Dean Kramer
*Attorney, Agent, or Firm*—Martin Fruitman

[57] ABSTRACT

The apparatus is an abrasion guard for the webbing used with a lifting sling fitting. The abrasion guard is essentially a rod of polyethylene with a slot along one entire longitudinal edge and extensions or "ears" on both ends of the rod. The extensions have vertical slots centered on their outside edges. The shape permits a properly dimensioned guard to be snapped onto and around the inner edge of the straight bar of a "D" ring fitting, with the extensions extending up along the sides of the "D" ring. The extensions are made large enough in the dimension transverse to the plane of the "D" ring so that they extend beyond the thickness of the webbing looped around the straight bar of the ring and the abrasion guard. The extensions thereby act as skids to protect the webbing from damage as the ring is moved across an abrasive surface.

6 Claims, 2 Drawing Sheets

ABRASION GUARD FOR LIFTING SLING FITTINGS

BACKGROUND OF THE INVENTION

This invention deals generally with hand and hoist line implements, and more specifically with an abrasion guard for "D" rings on lifting slings.

The typical end fitting on a lifting sling is a "D" ring, that is, a simple loop of metal with a somewhat triangular shape. Such a "D" ring is usually built with the base of the triangle as a straight bar and the two sides meeting at an apex which is curved to accommodate a lifting hook. The lifting sling webbing is then looped around the straight base bar of the triangle and closed by sewing.

Such lifting slings function very well for many uses, but, in some applications, particularly where the lifting sling is dragged across the ground, the floor, or the material being handled, the webbing around the straight bar is easily damaged and the useful life of the lifting sling is dramatically shortened. Because the webbing around the base bar is the thickest portion of the assembly, it is the webbing itself that is in contact with the ground or floor surface, and it is severely abraded as it is repeatedly pulled over the surface.

This problem is particularly severe for the lifting slings used in lumber sorting systems. In such equipment, the lifting sling is dragged across the floor or through the lumber at the end of each sorting cycle which accumulates a bundle of lumber. Since such sorting cycles are repeated frequently and continuously, the webbing on the "D" ring is subjected to severe abrasion, and the slings must be replaced often.

Two prior art patents have addressed the problem of external abrasion of the webbing which is wrapped around the base bar of "D" rings. U.S. Pat. No. 3,583,750 by Norton discloses a sling fitting which has a thinner cross section around which the webbing is looped, with larger cross sections on the portions of the fitting immediately adjacent to the edges of the webbing. Norton notes that this structure forms shoulders on either side of the webbing to protect the webbing from abrasion. U.S. Pat. No. 5,123,690 by Bailey discloses a wear pad which is welded to an additional bar across the "D" ring, with the wear pad protruding transverse to the webbing and thereby acting as a protective skid to hold the webbing off the surface along which it is being moved.

Both of these prior art solutions to the problem are complex and expensive. They require the construction of heavy special fittings which are structurally complex and therefore difficult and expensive to manufacture. Moreover, additional weight in a lifting fixture for a lumber sorter increases the likelihood that the fixture will damage the lumber.

SUMMARY OF THE INVENTION

The present invention is an abrasion guard for the webbing used with a conventional simple "D" ring which is simple to construct and use and adds very little weight to the fixture. The invention takes advantage of the fact that many "D" rings are constructed by flame cutting the shape from flat steel plate and then finished to round the resulting sharp edges. The "D" ring thus is a closed loop with all sides of equal thickness and in a single plane.

Therefore, the abrasion guard is essentially a rod of plastic material with a slot along one entire longitudinal edge and with transverse extensions or "ears" on both ends of the rod protruding away from the longitudinal slot. The extensions also have vertical slots centered on their outside edges. This shape permits a properly dimensioned guard to be snapped onto and around the inner edge of the straight base of a "D" ring, with the extensions protruding up along the sides of the "D" ring. The extensions are also made large enough in the dimension transverse to the plane of the "D" ring so that they extend well beyond the outer surface of the webbing looped around the base of the ring and the rod of the abrasion guard. The extensions thereby act as skids to protect the webbing from damage as the ring is moved across an abrasive surface.

This simple abrasion guard structure is constructed independently from the "D" ring itself, and therefore provides the advantage of the capability of using the high production techniques available for plastics. Furthermore, the "D" ring itself can be used either with or without the abrasion guard, thereby eliminating the cost of producing a special fitting to protect the webbing for applications which involve abrasion.

The present invention therefore furnishes a versatile and inexpensive device to prevent damage to sling webbing from abrasion caused by pulling the sling and its end fitting across a surface.

DETAILED DESCRIPTION OF THE INVENTION

Figure 1:
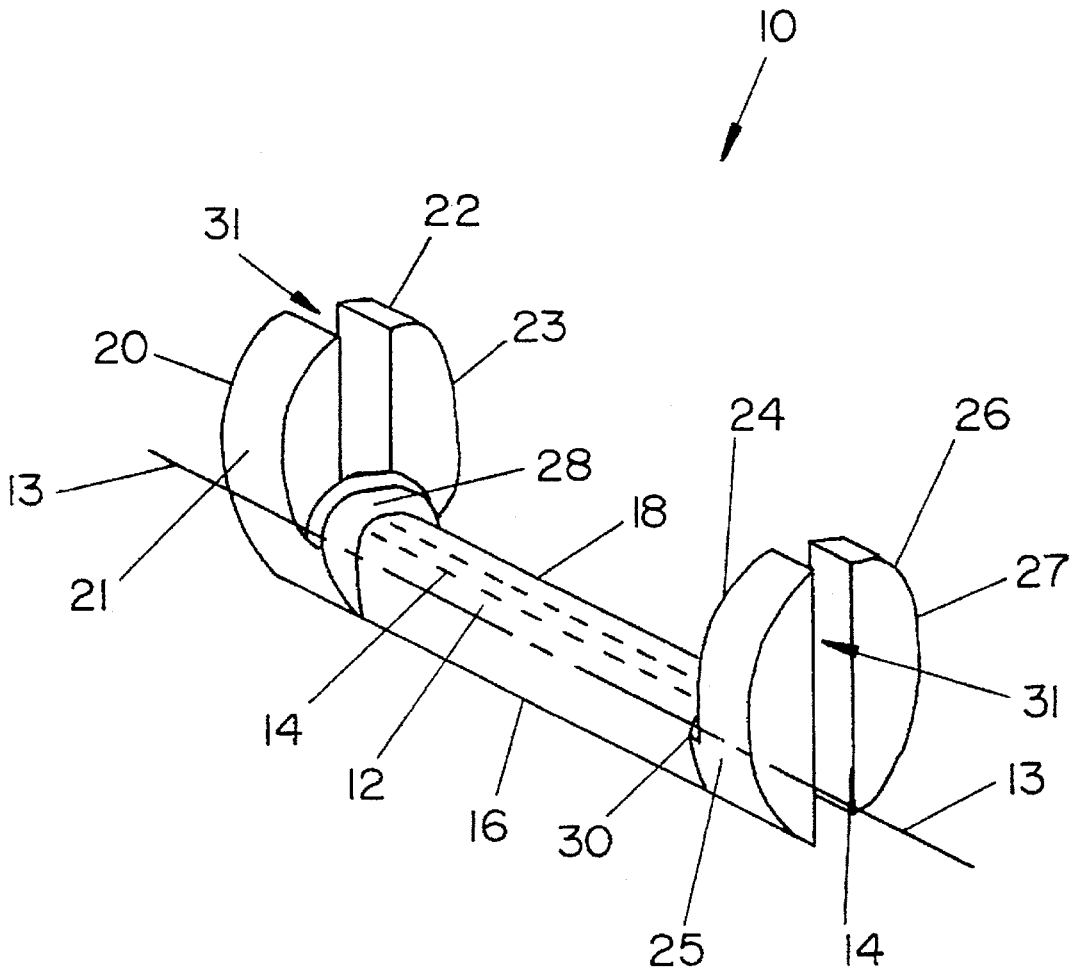
FIG. 1 is a perspective view of the preferred embodiment of the abrasion guard of the invention.

FIG. 1 is a perspective view of the preferred embodiment of abrasion guard 10 of the invention in which rod 12 includes slot 14. Longitudinal slot 14 is parallel to axis 13 of rod 12 and extends the entire length of rod 12 and opens onto first surface 16 of rod 12. However, slot 14 does not penetrate the opposite surface 18 of rod 12. For convenience, surface 16 can be referred to as the bottom surface, and surface 18 is referred to as the top surface. It should be appreciated that this orientation, although it is frequently used, is not required for the operation of either abrasion guard 10 or the "D" ring upon which it is installed. However, regardless of the orientation of the "D" ring, surface 18 is always located on the inside of the loop of the "D" ring with which abrasion guard 10 is used.

Transverse sections 20, 22, 24, and 26 are formed at opposite ends of rod 12 and are all oriented so that they extend in planes transverse to axis 13 of rod 12. Sections 20, 22, 24, and 26 each have skid surfaces 21, 23, 25, and 27, respectively, which are offset from the surfaces of rod 12. The dimensions of transverse sections 20, 22, 24, and 26 are selected so that each of the transverse section skid surfaces 21, 23, 25, and 27 extend beyond the surfaces of rod 12 by at least the thickness of the webbing which will eventually be wrapped around rod 12. This dimension assures that, with the webbing installed, when abrasion guard 10 and the "D" ring upon which it is installed are moved across a flat surface, the webbing will not be abraded because the "D" ring will slide upon skid surfaces 21, 23, 25, and 27.

The additional thickness between extensions 20, 22, 24, and 26 compared to that of rod 12 is actually furnished in the preferred embodiment of FIG. 1 by shoulders 28 and 30. The additional height of extensions 20, 22, 24, and 26 is desirable to space the webbing from the sides of the "D" ring, to strengthen abrasion guard 10 and to better lock it in place upon the "D" ring. Of course, opposite extensions 20 and 22 and opposite extensions 24 and 26 must be separated by spaces 31 which are approximately equal to the thickness of the "D" ring with which abrasion guard 10 is used, but it is preferred that spaces 31 provide an interference fit with the sides of the "D" ring.

Figure 2:
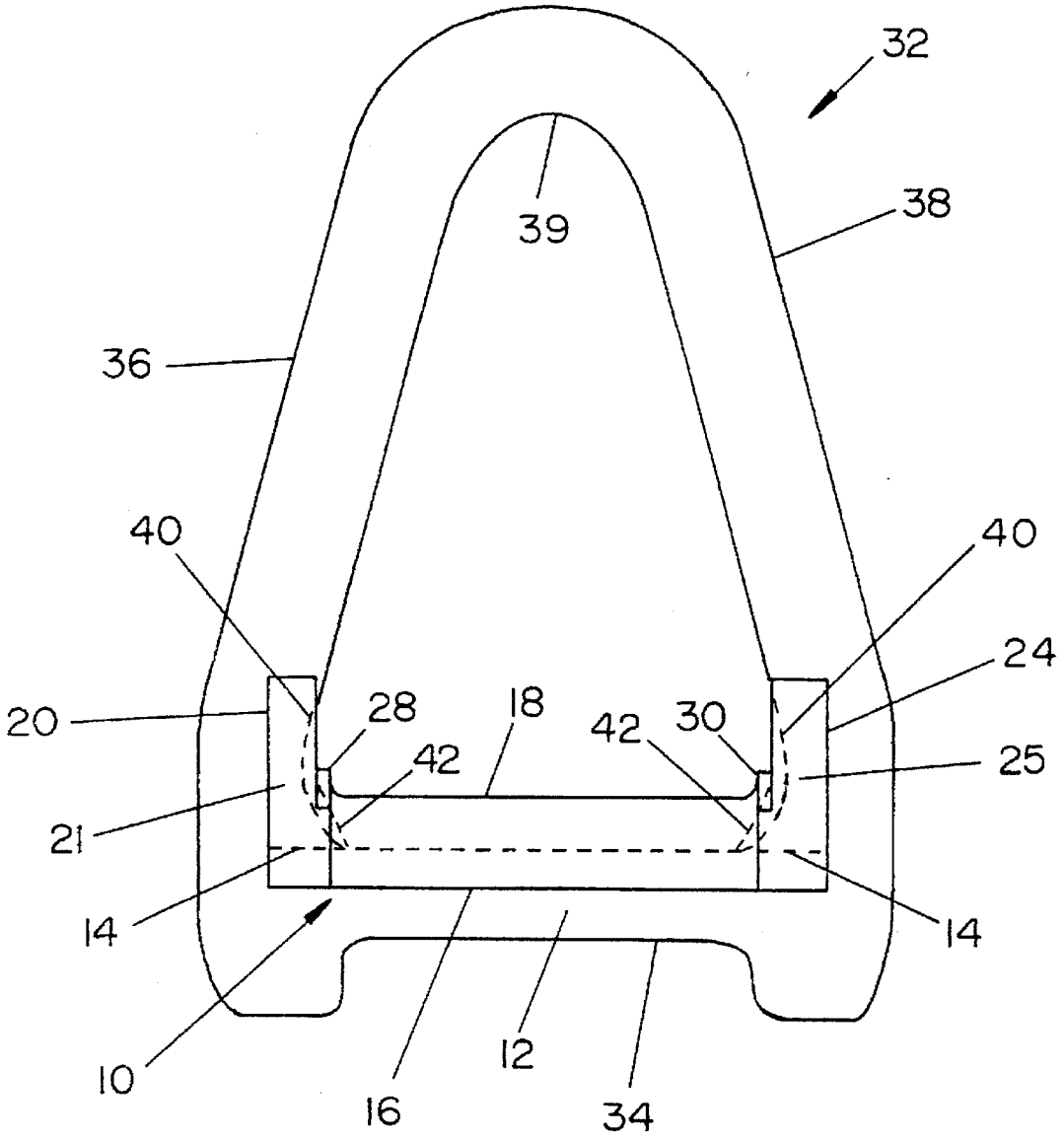
FIG. 2 is a front view of the abrasion guard installed upon a conventional "D" ring.

FIG. 2 is a front view of abrasion guard 10 as installed upon conventional "D" ring 32. As previously discussed, "D" ring 32 is a simple loop of metal with a somewhat triangular shape in a single plane. "D" ring 32 is built with the base of the triangle as straight base bar 34 and the two sides of the triangle, 36 and 38, meeting at curved apex 39 which accommodates a lifting hook (not shown). The lifting sling webbing (also not shown) is then conventionally wrapped around straight base bar 34 of "D" ring 32 and rod 12 of abrasion guard 10, and the webbing is closed by sewing.

The dashed lines in FIG. 2 are used to show the inner boundary 40 of "D" ring 32, the location of slot 14 in rod 12, and curved junctions 42 between slot 14 and spaces 31 (FIG. 1) which separate extensions 20 and 22 and spaces 24 and 26.

In the preferred embodiment of the invention abrasion guard 10 is constructed of polyethylene. This material provides enough flexibility for rod 12, the walls of slot 14, and extensions 20, 22, 24, and 26 to permit abrasion guard 10 to be forced around base bar 34 and sides 36 and 38 after "D" ring 32 is manufactured. The installation of abrasion guard 10 therefore has little effect on the production process, since it is a simple step which easily takes place just before the webbing is sewed onto the "D" ring.

Once installed, abrasion guard 10 is held in place by its clamping action on "D" ring 32, which is a result of the selection of interference fits on the surfaces in contact with the "D" ring, and the flexibility and plasticity of abrasion guard 10, which also make installation easier.

The invention thus furnishes an inexpensive abrasion guard which can be installed on conventional "D" rings, and does not require any special construction of the "D" ring or any special machinery for installation.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, other materials may be used for abrasion guard 10, and extensions 20, 22, 24, and 26 could be reduced in height, as long as their dimensions transverse to the plane of "D" ring 32 are sufficient to protect the webbing.

What is claimed as new and for which Letters Patent of the United States are desired to be secured is:

1. An abrasion guard for webbing on lifting sling fittings comprising:

a rod with two ends and a longitudinal slot, with the slot dimensioned to fit around a first section of a fitting around which webbing is to be wrapped so that the rod will cover at least part of the first section of the fitting; and extensions attached to the two ends of the rod, with the extensions dimensioned so that they protrude transverse to the rod from at least two opposite surfaces of the rod by a distance greater than the thickness of the webbing to be used;

wherein there are two extensions on each end of the rod, and the two extensions at each end are separated from each other and protrude from the rod so that together the two extensions on each end will clamp upon a section other than the first section of the fitting upon which the rod is installed.

2. The abrasion guard of claim 1 further including shoulders at each end of the rod to maintain a space between webbing wrapped on the rod and other sections of the fitting.

3. The abrasion guard of claim 1 wherein the abrasion guard is constructed of polyethylene material.

4. A lifting sling comprising:

a fitting with sides in a single plane constructed as a closed form, with one side comprising a straight bar, and two sides adjacent to the straight bar meeting the straight bar at acute angles;

an abrasion guard mounted upon the straight bar, the abrasion guard comprising:

a rod with two ends and a longitudinal slot, with the slot dimensioned to fit around a surface of the straight bar which faces the other two sides of the fitting; and extensions attached to the two ends of the rod, with the extensions dimensioned so that they protrude transverse to the rod from at least two opposite surfaces of the rod by a distance greater than the thickness of webbing to be used with the fitting; and webbing wrapped around the rod and closed to form a loop around the rod;

wherein there are two extensions on each end of the rod, and the two extensions at each end are separated from each other and protrude from the rod so that together the two extensions on each end clamp upon an adjacent side of the fitting.

5. The lifting sling of claim 4 further including shoulders at each end of the rod to maintain a space between the webbing wrapped around the rod and the adjacent two sides of the fitting.

6. The lifting sling of claim 4 wherein the abrasion guard is constructed of polyethylene material.

* * * * *